United States Patent [19]

Meuwes

[11] 4,010,398

[45] Mar. 1, 1977

[54] ELECTRIC DEVICE PROVIDED WITH A GAS AND/OR VAPOR DISCHARGE LAMP

[75] Inventor: Willy Frans Lucia Meuwes, Eindhoven, Netherlands

[73] Assignee: U.S. Philips Corporation, New York, N.Y.

[22] Filed: Aug. 26, 1975

[21] Appl. No.: 607,773

[30] Foreign Application Priority Data

Sept. 18, 1974 Netherlands ..... 7412330

[52] U.S. Cl. ..... 315/101; 315/203; 315/205; 315/207; 315/241 R; 315/DIG. 5

[51] Int. Cl.[2] ..... H05B 39/00; H05B 41/14

[58] Field of Search ..... 315/46, 49, 33, 47, 315/48, 51, 59, 330, 241 R, 205, 200 R, 207, 37, 39.63, 179, 101, 203, DIG. 5; 313/198

[56] References Cited

UNITED STATES PATENTS

| | | | |
|---|---|---|---|
| 3,629,647 | 12/1971 | Lake | 315/59 |
| 3,666,986 | 5/1972 | Lake et al. | 315/49 |
| 3,710,184 | 1/1973 | Williams | 315/DIG. 5 |
| 3,771,018 | 11/1973 | Medendorp et al. | 315/51 |
| 3,787,751 | 1/1974 | Farrow | 315/205 |

*Primary Examiner*—Saxfield Chatmon, Jr.
*Attorney, Agent, or Firm*—Frank R. Trifari; Bernard Franzblau

[57] ABSTRACT

The invention relates to a mixed-light lamp. According to the invention the lamp is connected to a cascade circuit of two capacitors and two diodes. The increase in voltage obtained with that cascade circuit is fed to an auxiliary electrode of the discharge tube of the mixed light lamp.

All electric circuit element of the device are located within the lamp. The lamp described is particularly suitable to be operated by an AC mains circuit of a relatively low voltage.

14 Claims, 3 Drawing Figures

ELECTRIC DEVICE PROVIDED WITH A GAS AND/OR VAPOR DISCHARGE LAMP

The invention relates to an electric device provided with two input terminals and a gas and/or vapour discharge lamp having a discharge tube with at least two main electrodes. The input terminals are adapted to be connected to an AC voltage source while the lamp can be started and supplied with power through these input terminals. A cascade circuit is included consisting of two series circuits, which each comprise a rectifier and a capacitor. The second series circuit forms a closed circuit with the rectifier of the first series circuit. An electrode path of the tube and a first resistor shunts the capacitor of the second series circuit. The term electrode path of the tube is used herein to mean the path between two electrodes of the tube.

A known device of the said type is described in U.S. Pat. No. 3,629,647. A disadvantage of that known device is that yet another capacitor is included in series with the lamp, which capacitor is used to stabilize the lamp current. Furthermore, when the supply voltage is obtained from a 120 volt 60 Hz power supply system, a leakage reactance transformer is included.

An object of the invention is to provide an electric device as mentioned above which enables starting and feeding of the lamp from an AC supply of a relatively low voltage and with a very small number of electric circuit elements.

An electric device according to the invention, provided with two input terminals and a gas and/or vapour discharge tube with at least two main electrodes in which the input terminals are intended for connection to an AC voltage source and in which the lamp can be started and fed through said input terminals and which includes a cascade circuit consisting of two series circuits, each consisting of a rectifier and a capacitor, the second series circuit forming a closed circuit with the rectifier of the first series circuit, and wherein an electrode path of the tube together with a first resistor shunts the capacitor of the second series circuit, is characterized in that the said electrode path leads from an auxiliary electrode to a main electrode of the discharge tube and that the main electrode path between the main electrodes of the discharge tube, in series with a current limiting circuit element shunts a part of the cascade circuit, which part comprises at least the capacitor of the second series circuit, and that the first series circuit of the cascade circuit is connected directly to the input terminals of the device.

An important feature of the invention is that the voltage doubling achieved by means of the pairs of capacitors and diodes results in a high voltage at an auxiliary electrode of the discharge tube. Owing to this, amongst other things, a device according to the invention has the advantage that by the said combination of two capacitors, two rectifiers and two current limiting circuit elements such as, for example, resistors, the required starting and feeding of the discharge tube can be effected from a supply circuit of a relatively low voltage.

Starting and feeding a discharge lamp which is provided with a discharge tube which is equipped with an auxiliary electrode, by means of a circuit incorporating rectifiers and capacitors is indeed known, see for example FIG. 2 of U.S. Pat. No. 3,666,986, but in that case four rectifiers are mounted. In this known circuit full wave rectification occurs which has the additional disadvantage that the discharge tube current flows through all four rectifiers so that these rectifiers must be rated for that current. This disadvantage is avoided when a cascade circuit according to the invention is used. The last mentioned United States Patent also describes a circuit without capacitors. A disadvantage of that circuit is, however, that an increased voltage for starting the lamp is not available, so that starting from a voltage supply of relatively low voltage is not possible. This known circuit also was not equipped with a cascade circuit according to the invention.

In a device according to the invention the auxiliary electrode is for example, an internal electrode of the discharge tube. This means that that auxiliary electrode is located inside the discharge tube. In the case of an internal auxiliary electrode, that auxiliary electrode is, for example, connected to a separately positioned first resistor. If the auxiliary electrode is an external auxiliary electrode, the associated resistor may be, for example, a part of the wall of the discharge tube. The external auxiliary electrode may then be, for example, curl-shaped.

The discharge tube is, for example, a sodium vapour discharge tube or a mercury vapour discharge tube or the discharge tube may contain yet another filling.

The current limiting circuit element in a device according to the invention may be, for example, a coil. An advantage of the fact that this current limiting circuit element is incorporated in a branch which shunts at least a part of the cascade circuit is that charging of the capacitors is not inhibited by this current limiting circuit element. This is important for first starting the discharge tube and for any restartings.

In a preferred embodiment of an electric device according to the invention the current limiting circuit element is a second resistor.

An advantage of this preferred construction is that the second resistor may also act as a source of radiation. In that case the device is, for example, a sunlamp. The discharge tube then radiates ultra-violet rays while infrared radiation is produced with the second resistor.

In another improvement of the last-mentioned preferred embodiment the combination of the discharge tube and the second resistor takes the form of a mixed-light lamp in which the second resistor is the filament.

An advantage of this improvement is that the device can radiate a combination of visible discharge light and incandescent light.

In a further preferred embodiment of an electric device according to the invention the part of the cascade circuit that is shunted by the series circuit of the main electrode path and the current limiting circuit element consists of the series connection of the second series circuit and the capacitor of the first series circuit.

An advantage of this preferred construction is that the intensity of the current through the two capacitors, the two diodes and the first resistor may be very low because of the fact that these currents need only be used for starting the lamp. The electric circuit elements mentioned in the previous sentence may then be small and can be easily incorporated into a part of the lamp, for example in the lamp base.

In a following preferred construction of a device according to the invention the part of the cascade circuit that is shunted by the series circuit of the main electrode path and the current limiting circuit element consists of the capacitor of the second series circuit only.

An advantage of this last-mentioned preferred construction is that the discharge tube can be fed with a pulsating direct current in the normal operating condition. Also in this embodiment starting of the lamp is again ensured by the high voltage which is applied to the auxiliary electrode of that tube. This is again achieved with the cascade circuit of the two rectifiers and the capacitors. A difference now is, however, that in the normal operating condition the discharge tube current flows through the first capacitor and the second rectifier. Therefore, these two circuit elements must be proportioned for this current. The advantage of the pulsating direct current is that a higher operating voltage of the discharge tube may then be chosen so that this tube can be subjected to a higher load, i.e. a higher power can be applied to it. In turn this leads to an increased production of radiation by means of this tube.

Some of the electric circuit elements, for example parts of the cascade circuit, may be located outside the lamp, for example may be combined with supply wires of the lamp.

In a further preferred construction of a device according to the invention all circuit elements of the device are located within the lamp.

An advantage of this construction is that the lamp forms the entire device. This lamp can then be placed as such in a lampholder which is connected directly to the supply circuit. It is possible that in that case a number of the circuit elements are incorporated in the lamp base.

The discharge lamp may have a high starting voltage of, for example, 300 volts. This lamp could then be operated with a device according to the invention, for example in a 220 volt 50 Hz supply circuit.

In a device according to the invention which is destined for connection to a supply circuit of approximately 100 to 130 volts, a mixed-light lamp which is provided with a high pressure mercury vapour discharge tube whose starting voltage is even 180 volt r.m.s. can be properly started.

An advantage of this device is that such a mixed-light lamp with a relatively high starting voltage can be started in a simple manner when connected to a supply circuit of 100 to 130 volts which is found in some parts of the world.

The invention will be further explained with reference to the accompanying drawing, in which.

Figure 1:
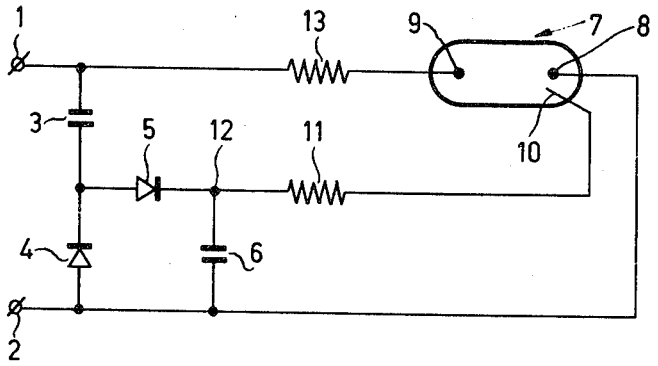
FIG. 1 shows a first electric circuit of a device according to the invention, the device being a mixed-light lamp.

In FIG. 1 terminals 1 and 2 are adapted for connection to a low-frequency AC voltage supply circuit of approximately 120 volts. The terminals 1 and 2 are interconnected by means of a first series circuit comprising a capacitor 3 and a rectifier 4. This first series circuit is part of a cascade circuit. The cascade circuit also comprises a second series circuit comprising a rectifier 5 and a capacitor 6. Together with the rectifier 4, this second series circuit forms a closed circuit with the pass directions of the rectifiers 4 and 5 poled in the same direction. Reference numeral 7 designates a high pressure mercury vapour discharge tube of 50 watts. This diagrammatically represented tube 7 is provided with two main electrodes 8 and 9 and with an internal auxiliary electrode 10. Via a resistor 11 the auxiliary electrode 10 is connected to a junction 12 between the rectifier 5 and the capacitor 6. Via a resistor 13 (of approximately 60 ohms) which is in the form of a filament, the main electrode 9 is connected to terminal 1. In its turn the main electrode 8 is connected to the input terminal 2. The capacitance of the capacitor 3 is about 0.47 $\mu$F that of capacitor 6 is also about 0.47 $\mu$F. The resistor 11 has a value of about 20 kOhms. The total power of the discharge tube 7 with the filament 13 is about 50 W + 110 W = 160 W. The starting voltage of the high pressure mercury vapour discharge tube 7 is approximately 140 V and the operating voltage is approximately 45 V.

The discharge tube 7 is started by means of an increase in voltage which is realized by the fact that first the capacitor 3 is charged from the supply circuit via the rectifier 4 and thereafter the capacitor 6 is charged via the rectifier 5. The high voltage which is then across capacitor 6 also appears between the auxiliary electrode 10 and the main electrode 8 of the tube 7. This auxiliary voltage promotes the starting action between the main electrodes 9 and 8. After the tube 7 has been started the current through this discharge tube is stabilized by the filament 13.

Figure 3:
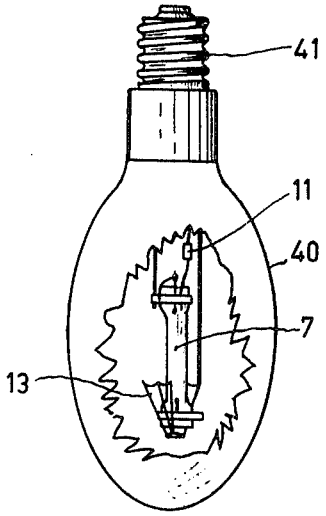
FIG. 3 shows a longitudinal section, partly in an elevational view of a mixed-light lamp provided with the electric circuit of FIG. 1.

In one preferred embodiment (see FIG. 3) all circuit elements of FIG. 1 are located within the lamp which is, inter alia, equipped with an outer bulb 40 which envelops the discharge tube 7 and the filament 13, the circuit elements 1, 2, 3, 4, 5 and 6 being incorporated in a lamp base 41. The resistor 11 is located within the outer bulb 40.

Figure 2:
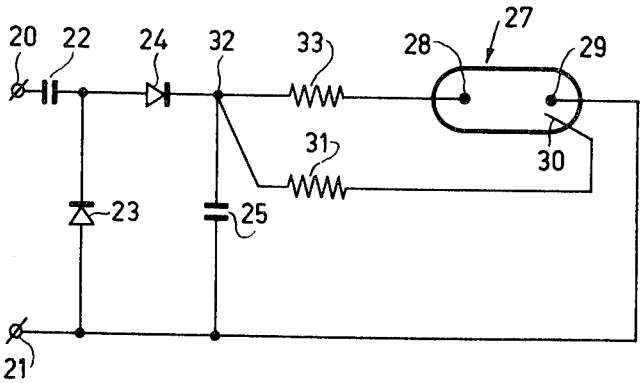
FIG. 2 shows a second electric circuit of a device according to the invention in which the device is constructed as a sunlamp.

In FIG. 2 terminals 20 and 21 are meant for connection to a low-frequency AC voltage supply circuit of 120 V. The embodiment concerned is an artificial sun device having an ultra-violet (UV) radiator 27 and an infra-red (IR) radiator 33. The terminals 20 and 21 are interconnected by means of a first series combination of a capacitor 22 and a rectifier 23 of a cascade circuit. The cascade circuit also comprises a second series combination of a rectifier 24 and a capacitor 25. Together with the rectifier 23 the second series combination (24,25) forms a closed circuit. The pass directions of the rectifiers 23 and 24 are in the same direction. The UV-radiator 27 is a high pressure mercury vapour discharge tube of 120 W which is provided with two main electrodes 28 and 29 and with an internal auxiliary electrode 30. Via a resistor 31 the auxiliary electrode 30 is connected to a junction 32 which is located between the rectifier 24 and the capacitor 25. The main electrode 28 of the discharge tube 27 is connected to the junction 32 via the resistor 33 in the form of an infra-red radiator. The main electrode 29 is connected to input terminal 21.

Broadly speaking the starting procedure for the discharge tube 27 is the same as the starting procedure for the discharge tube 7 shown in FIG. 1. Starting is effected with an increase in voltage which is realized because first capacitor 22 is charged via rectifier 23 and thereafter capacitor 25 is charged via rectifier 24. The resulting high voltage across the capacitor 25 is then also produced between the auxiliary electrode 30 and the main electrode 29 of the tube 27. Contrary to the circuit of FIG. 1, the same voltage — prior to the starting of the tube — is applied between the main electrodes 28 and 29. As a result the tube 27 is started. After the tube 27 has been started a current will flow in the circuit 20, 22, 24, 33, 28 and 29 to the terminal 21. This occurs during the positive half periods of the supply voltage set up between the terminals 20 and 21, namely during those half periods in which the terminal 20 is positive with respect to terminal 21. In the intermediate half periods the capacitor 25, which is charged in the positive half period, will discharge across the discharge tube 27. This means that a pulsating direct current will flow in the tube 27.

In the case of FIG. 2 the capacitance of the capacitor 22 was approximately 300 $\mu$F and of the capacitor 25 approximately 300 $\mu$F. The resistor 31 had a value of approximately 20 kOhm.

When comparing, at the same total power (in watts), the described artificial sun device according to the invention (see FIG. 2) with a known artificial sun device - i.e. one not according to the invention — in which an UV discharge tube in series with an infra-red radiator was connected directly to the AC power supply circuit, the picture illustrated in the Table below was obtained.

It should be noted in this respect that the ultraviolet (UV) radiation in the case not according to the invention (central column of the table) was provided with one starter filament which was located near one of the main electrodes of the tube. In the case according to the invention (right-hand column) an auxiliary electrode as designated in FIG. 2 was included instead of a starter filament.

TABLE

| | not according to the invention | according to the invention |
|---|---|---|
| Supply voltage (Volt) | 120 AC voltage | 120 AC voltage |
| Operating voltage (Volt) UV-radiator | 50 | 150 |
| Ohmic value (Ω) IR-radiator | 34 | 200 |
| Total power (Watt) | 245 | 245 |
| Power IR-radiator (Watt) | 165 | 125 |
| Power UV-radiator (Watt) | 80 | 120 |

The Table shows that the sun lamp according to the invention has the advantage of a larger contribution by the UV radiator. This means inter alia a higher efficiency of the radiation generation. This was made possible because a cascade circuit according to the invention made it possible to use discharge tubes with higher operating voltages.

What is claimed is:

1. An electric device comprising a discharge lamp having an electric discharge tube with at least two main electrodes and an auxiliary electrode, two input terminals adapted for connection to an AC voltage source to supply the lamp with power, a cascade circuit including two series circuits each of which comprises a rectifier and a capacitor in series, means connecting the second series circuit to form a closed circuit with the rectifier of the first series circuit, a first resistor, means connecting an electrode path of the discharge tube and said first resistor in shunt with the capacitor of the second series circuit, said electrode path being formed between the auxiliary electrode and a main electrode of the discharge tube, means connecting the main electrode path formed between the main electrodes of the discharge tube in series with a current limiting circuit element and in shunt with a part of the cascade circuit, which part comprises at least the capacitor of the second series circuit, and means connecting the first series circuit of the cascade circuit directly to the input terminals of the device.

2. An electric device as claimed in claim 1, characterized in that the current limiting circuit element comprises a second resistor.

3. An electric device as claimed in claim 2, wherein the second resistor comprises a filament so that the combination of the discharge tube and the second resistor forms a mixed-light lamp.

4. An electric device as claimed in claim 1, wherein the part of the cascade circuit that is shunted by the series combination of the tube main electrode path and the current limiting circuit element comprises the series connection of the second series circuit and the capacitor of the first series circuit.

5. An electric device as claimed in claim 1, wherein the part of the cascade circuit that is shunted by the series combination of the tube main electrode path and the current limiting circuit element includes the capacitor of the second series circuit only.

6. An electric device as claimed in claim 3, characterized in that all circuit elements of the device are located within the mixed-light lamp.

7. A ballast and starting circuit for an electric discharge tube having two main electrodes and an auxiliary electrode comprising, a pair of input terminals for supplying an AC voltage to the circuit, a voltage doubler circuit comprising first and second stages connected in cascade to said input terminals, the first stage including a first capacitor and a first rectifier connected in a first series circuit, the second stage including a second capacitor and a second rectifier connected in a second series circuit across the first rectifier so that the first and second rectifiers and the second capacitor form a closed loop circuit, a first impedance element, means connecting the electrode path formed between the tube auxiliary electrode and a main electrode in a series arrangement with said first impedance element and said series arrangement in shunt with the second capacitor, a second impedance element, means connecting the second impedance element and the main electrode path of the discharge tube in series across the input terminals and in shunt with a part of the cascade circuit that includes at least the second capacitor, said first series circuit being connected directly to said input terminals.

8. A circuit as claimed in claim 7 wherein said first and second impedance elements comprise a first resistor and a second filament resistor.

9. A circuit as claimed in claim 7 wherein said first capacitor, said second rectifier and said second capacitor are connected to form a further series circuit across the input terminals and the series combination of the second impedance element and the tube main electrode path shunts said further series circuit.

10. A circuit as claimed in claim 7 wherein the part of the cascade circuit shunted by the series combination of the second impedance element and the tube main electrode path includes only said second capacitor.

11. A circuit as claimed in claim 7 wherein said first capacitor and said second rectifier are connected in series with the second impedance element and the tube main electrode path across the input terminals.

12. A circuit as claimed in claim 7 wherein said first and second rectifiers comprise first and second diodes, respectively, connected with the same polarity in the closed loop circuit.

13. A circuit as claimed in claim 7 wherein said second impedance element includes an infra-red radiation element and said discharge tube emits ultra-violet radiation.

14. A circuit as claimed in claim 7 wherein the series combination of the second impedance element and the tube main electrode path is connected directly across the input terminals and in shunt with the voltage doubler circuit.

* * * * *